US008021081B2

(12) United States Patent
Crotwell et al.

(10) Patent No.: US 8,021,081 B2
(45) Date of Patent: Sep. 20, 2011

(54) PULL-STYLE TENSIONER SYSTEM FOR A TOP-TENSIONED RISER

(75) Inventors: Gerald Crotwell, Sugar Land, TX (US); Alan Yu, Houston, TX (US)

(73) Assignee: Technip France, Courbevoie (FR)

( * ) Notice: Subject to any disclaimer, the term of this patent is extended or adjusted under 35 U.S.C. 154(b) by 893 days.

(21) Appl. No.: 11/761,061

(22) Filed: Jun. 11, 2007

(65) Prior Publication Data

US 2008/0304916 A1 Dec. 11, 2008

(51) Int. Cl.
*E02D 5/40* (2006.01)

(52) U.S. Cl. ..... 405/223.1; 405/224.4; 166/355

(58) Field of Classification Search ..... 405/223.1, 405/224.1, 224.2, 224.4; 166/354, 355, 367; 285/34, 35, 920

See application file for complete search history.

(56) References Cited

U.S. PATENT DOCUMENTS

| | | | | |
|---|---|---|---|---|
| 4,216,834 | A * | 8/1980 | Wardlaw | 175/7 |
| 4,351,261 | A | 9/1982 | Shanks | |
| 4,733,991 | A * | 3/1988 | Myers | 405/224.2 |
| 4,883,387 | A | 11/1989 | Myers et al. | |
| 5,310,007 | A | 5/1994 | Parikh | |
| 5,551,803 | A * | 9/1996 | Pallini et al. | 405/223.1 |
| 7,588,393 | B1 | 9/2009 | Shivers, III et al. | |
| 2005/0074296 | A1 | 4/2005 | McCarty et al. | |
| 2006/0280560 | A1 | 12/2006 | Ellis et al. | |

OTHER PUBLICATIONS

Partial International Search Report on corresponding PCT application (PCT/US2008/066441) from International Searching Authority (EPO) dated Feb. 5, 2010.

International Search Report on corresponding PCT application (PCT/US2008/066441) from International Searching Authority (EPO) dated May 31, 2010.

Written Opinion on corresponding PCT application (PCT/US2008/066441) from International Searching Authority (EPO) dated May 31, 2010.

* cited by examiner

*Primary Examiner* — John Kreck
*Assistant Examiner* — Sean Andrish
(74) *Attorney, Agent, or Firm* — Klein, O'Neill & Singh, LLP

(57) ABSTRACT

A tensioner system for a top-tensioned riser in a floating platform includes a hydro-pneumatic tensioner assembly resiliently mounted to the floating platform, and a riser support conductor surrounding the riser coaxially, wherein the support conductor conveys a pull-type tensional force from the hydro-pneumatic tensioner assembly to the riser through a riser conductor coupling assembly that engages the tensioner assembly and the riser support conductor to convey the tensional force. A riser tension joint support assembly conveys the tensional force from the riser support conductor to a riser tension joint on the riser. The tensioner assembly compensates for relative platform motion including pitch, heave, and yaw. Also a reactive load assembly is mounted to the platform and reacts to a two-point dynamic bending moment imposed on the riser support conductor, while resisting riser support conductor rotation.

26 Claims, 8 Drawing Sheets

PULL-STYLE TENSIONER SYSTEM FOR A TOP-TENSIONED RISER

CROSS-REFERENCE TO RELATED APPLICATIONS

Not Applicable

FEDERALLY-SPONSORED RESEARCH OR DEVELOPMENT

Not Applicable

BACKGROUND OF THE INVENTION

This invention relates generally to the field of floating offshore platforms or vessels for the exploitation of undersea deposits of petroleum and natural gas. More specifically, it relates to a system and apparatus for tensioning risers that extend from a subsea wellhead or subsurface structure to a floating platform or vessel.

Offshore platforms for the exploitation of undersea petroleum and natural gas deposits typically support production risers that extend to the platform from one or more wellheads or structures on the seabed. In deep water applications floating platforms (such as spars, tension leg platforms, extended draft platforms, and semi-submersible platforms) are typically used. These platforms are subject to motion due to wind, waves, and currents. Consequently, the risers employed with such platforms must be tensioned so as to permit the platform to move relative to the risers. Also, riser tension must be maintained so that the riser does not buckle under its own weight. Accordingly, the tensioning mechanism must exert a substantially continuous tension force to the riser within a well-defined range.

One broad class of risers is the category called "Top Tensioned Risers" or TTRs. Such risers extend from the subsea wellheads below the hull of the platform substantially vertically to the deck area of the platform, where they are supported by a tensioning mechanism; hence the term "Top Tensioned Riser." Each TTR typically extends from a riser tension point up into the production deck levels of the platform with the use of a heavy wall conduit or stem joint. At the top of the conduit or stem joint is an upper riser termination where a surface wellhead and a production tree or flow control device are mounted. (Platforms with such an arrangement are called "dry tree" platforms.) A flexible jumper attached to the production tree enables the produced well fluids to be transferred to the topside processing facilities.

Passive buoyancy cans are a well-known type of riser tensioning mechanism that is used primarily on spars. The buoyancy cans independently support each TTR, which allows the platform to move up and down relative to the riser. This isolates the risers from the heave motion of the platform and eliminates any increased riser tension caused by the horizontal offset of the platform in response to the marine environment.

Hydro-pneumatic tensioner systems are another form of riser tensioning mechanism used to support TTRs on various dry tree platforms. Hydro-pneumatic riser tensioning has its origins in the support of drilling risers of MODUs (mobile offshore drilling units). A plurality of active hydraulic cylinders with pneumatic accumulators is connected between the platform and the riser to provide and maintain the necessary riser tension. Platform responses to environmental conditions, mainly heave and horizontal motions causing hull setdown, necessitate changes in riser length relative to the platform, which causes the tensioning cylinders to stroke in and out. The spring effect caused by the gas compression or expansion during riser stroke partially isolates the riser from the low heave platform motions while maintaining a nearly constant riser tension. However, when the platform takes a significant horizontal offset, the compression of the gas in the cylinders causes increased cylinder pressure and thus increased riser tension. The magnitude of this increased riser tension is a function of the stiffness of the riser and the tensioning system.

Two major types of hydro-pneumatic tensioner systems are currently in use: the "push" or compression style system and the "pull" or tension style system. Both systems use hydraulic cylinders having pistons with piston rods connected to the riser by a tension ring device. Push-style cylinders are mounted with the piston rods looking up, and they use pressure applied to the piston side of the cylinders to provide riser tension. The piston rods effectively push up on the riser, putting the rods in compression while providing the necessary riser tension. The pull-style cylinders, by contrast, are mounted with the piston rods looking down. Pressure applied to the rod side of the cylinders puts the piston rods in tension while pulling up on the riser to generate the riser tension.

Pull-style tensioner systems have to date been used predominately on tension leg platforms (TLPs) to support TTRs. The tensioner cylinders may be symmetrically mounted under the well deck, outboard of the riser, using padeyes and shackles, or they can be mounted in a similar manner in a cassette frame that is then mounted to the well deck. The cylinders are angled inboard to riser attachment points on a tension ring. Generally, a roller assembly mounted at the well deck level above the tension ring is used to provide lateral support to the riser as it passes through the tensioner.

The pull-style tensioners on TLPs are designed for short strokes due to the low heave characteristics of the hull, combined with the relatively small riser length changes associated with small hull set down due to the parallelogram arrangement formed by the platform, tendons, risers, and the seafloor well pattern. The advantage is that the surface production tree or flow control device at the top of the riser on a TLP can be mounted closer to the tensioning point of the riser, and the well spacing inside the platform can be reduced. This reduces the bending loads induced in the portion of the riser above the tension point, i.e., the upper riser stem joint, from the dynamic motions of the surface production equipment. However, the production equipment for other hull types and riser system configurations may be located some distance away from the tensioning point. Because there is generally only one set of lateral motion restraining devices (such as rollers) to restrain the riser laterally, dynamic bending moments from the production equipment are transferred across the rollers and the tension ring into the riser pipe below the tension point. Also, riser vortex induced vibration (VIV) oscillations can be transferred across the tension ring and into the upper riser stem joint, possibly affecting its fatigue life.

If a tension cylinder failure occurs, the eccentric load generated by the unequal application of cylinder forces at the tension ring may also cause additional bending moments that must be reacted to by the riser pipe. The unbalanced cylinder forces can also cause the riser and the surface tree to lean to one side. The occurrence of dynamic bending moments from the production equipment and the failed cylinder scenario dictate that the tensioning cylinders be mounted so as to allow pivoting, such as with the use of padeyes and shackles. Pivot mounting eliminates the need for the cylinders and cylinder supports to react to the various loads. However, because the cylinders are generally hung from above to pull up and are also angled inboard to the riser, failed cylinder change-out is made more difficult because of the location of the cylinders below the hang-off deck.

Push-style tensioner systems are a more recent approach to riser tensioning and have been used on deepwater spars to support TTRs and drilling risers. Typically, four to six push-style cylinders are vertically mounted to the platform deck. A piston is journaled in each of the cylinders, each of the pistons being connected to an upwardly-extending piston rod that is attached to a structural top frame. The structural top frame, in turn, supports a large diameter conductor pipe and contains the tension ring attachment to the riser. The piston rods push up on the top frame, which, in turn, pushes up on the riser via a tension ring. The conductor pipe, with two sets of reaction rollers, creates a two-point force coupling to react to riser dynamic bending moments generated from the production equipment and failed cylinder-induced bending moments. The conductor pipe and the associated anti-rotation devices also resist riser torque induced by platform or vessel yaw motions. Because the rods are in compression and are required to resist buckling under very large loads, the rod diameters are larger than those of a pull-style tensioner system.

In general, while conventional pull-style tensioners, as described above, are generally smaller, less expensive, and more widely available than push-style tensioners, the typical pull-style tensioner system generally exhibits one or more of the following disadvantages: (1) It may not provide two-point reaction to riser dynamic bending moments generated by surface production equipment located above the riser tension point. (2) The lack of two-point reaction also allows riser VIV oscillations below the tension point to excite the surface equipment above the tension point, thus adversely affecting its fatigue life. (3) It may not react adequately to failed cylinder eccentric loads, thus creating additional riser bending moments. (4) It may not sufficiently resist riser rotation (torque) created by platform yaw motions. (5) Failed cylinder replacement is made more difficult by below-deck work requirements.

SUMMARY OF THE INVENTION

Broadly, the present invention is a pull-style, hydro-pneumatic tensioner system for a riser in a floating platform, comprising a riser support conductor coaxially surrounding the riser and operatively coupled to an upper end of the riser; and a plurality of hydro-pneumatic tensioners operatively coupled between the platform and a lower end of the riser support conductor so as to exert a pull-type tensional force on the riser support conductor, whereby the riser support conductor conveys the pull-type tensional force to the upper portion of the riser. The tensioner system of the present invention provides a two point reaction to riser loads, and also resists riser rotation from, e.g., platform yaw motions.

More specifically, a tensioner system for a top-tensioned riser in a floating platform, in accordance with an exemplary embodiment of the present invention, comprises a plurality of hydro-pneumatic tensioners, each comprising a hydraulically-actuated piston disposed for reciprocation within a hydraulic cylinder and including a piston rod having a lower end operatively coupled to the lower end of a riser support conductor by means of a support conductor coupling assembly; a riser tension joint support assembly operatively coupling an upper end of the riser support conductor to an upper end of the riser; and a support conductor reactive load assembly operatively coupling the support conductor to the platform so as to react to lateral loads and bending moments in the support conductor, and to resist the rotation of the support conductor about its longitudinal axis.

Hydro-pneumatic retraction of the tensioner rods in response to platform motion applies an upward tension force to the support conductor coupling assembly. Axial tension loads are thereby conveyed from the tensioners to the lower end of the support conductor by the support conductor coupling assembly, and then from the upper end of the support conductor to the upper end of the riser by the riser tension joint support assembly, thereby tensioning the riser.

The tensioner system of the present invention is intended primarily for use on spars, extended draft platforms (EDPs), and semi-submersibles to support top-tensioned risers. Nominal operating strokes of about 28 feet (about 9 meters) and nominal operating tension loads of about 1,500 to 2000 kips are typical, but can be varied to suit particular system applications.

DETAILED DESCRIPTION OF THE INVENTION

As used herein, the terms "invention" and "present invention" are to be understood as encompassing the invention described herein in its various embodiments and aspects, as well as any equivalents that may suggest themselves to those skilled in the pertinent arts.

Figure 1:
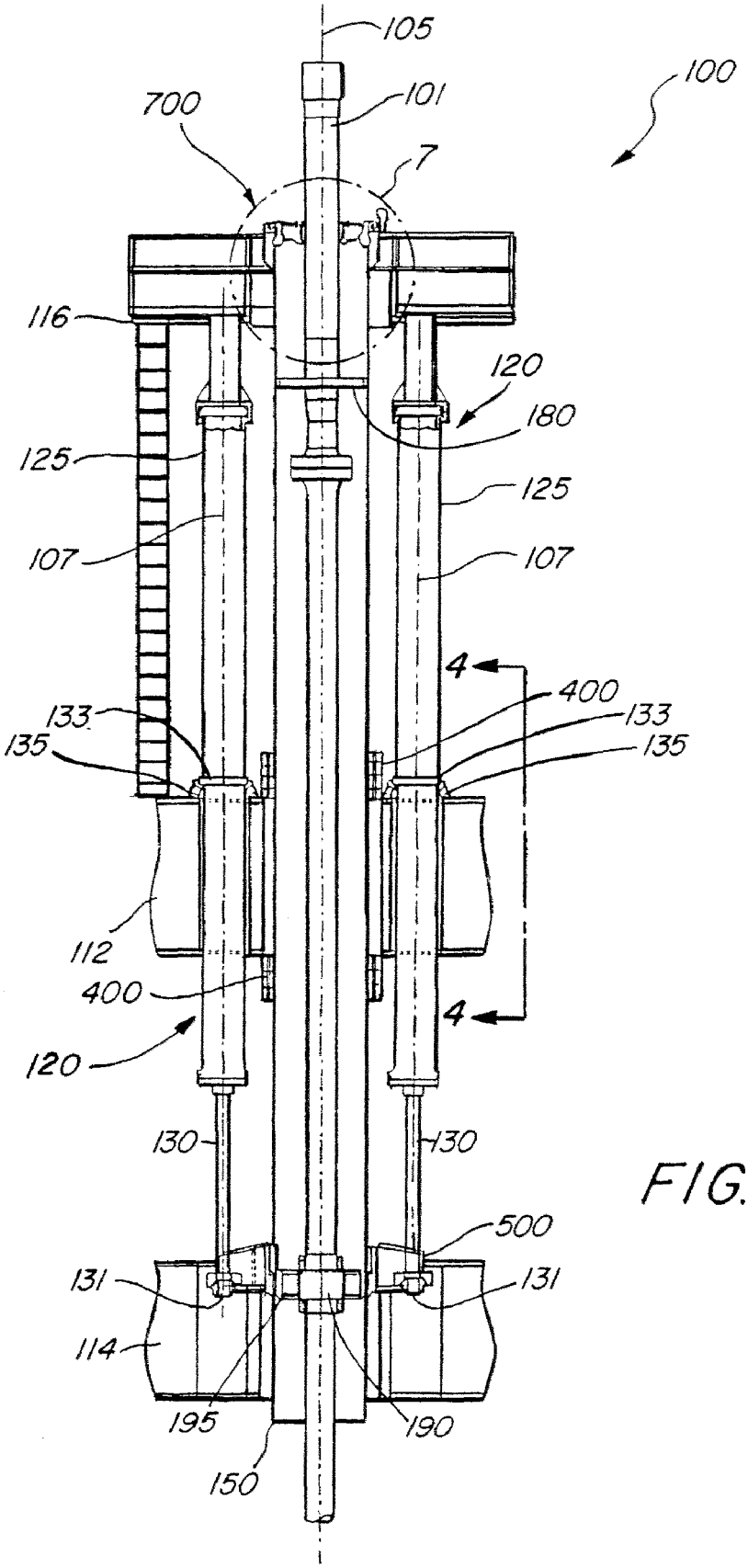
FIG. 1 is an elevational view, partially in cross-section, of an offshore platform including a tensioner system in accordance with one embodiment of the present invention including a hydro-pneumatic tensioner, in which the hydro-pneumatic tensioner is positioned at a generally nominal stroke position.
Figure 2:
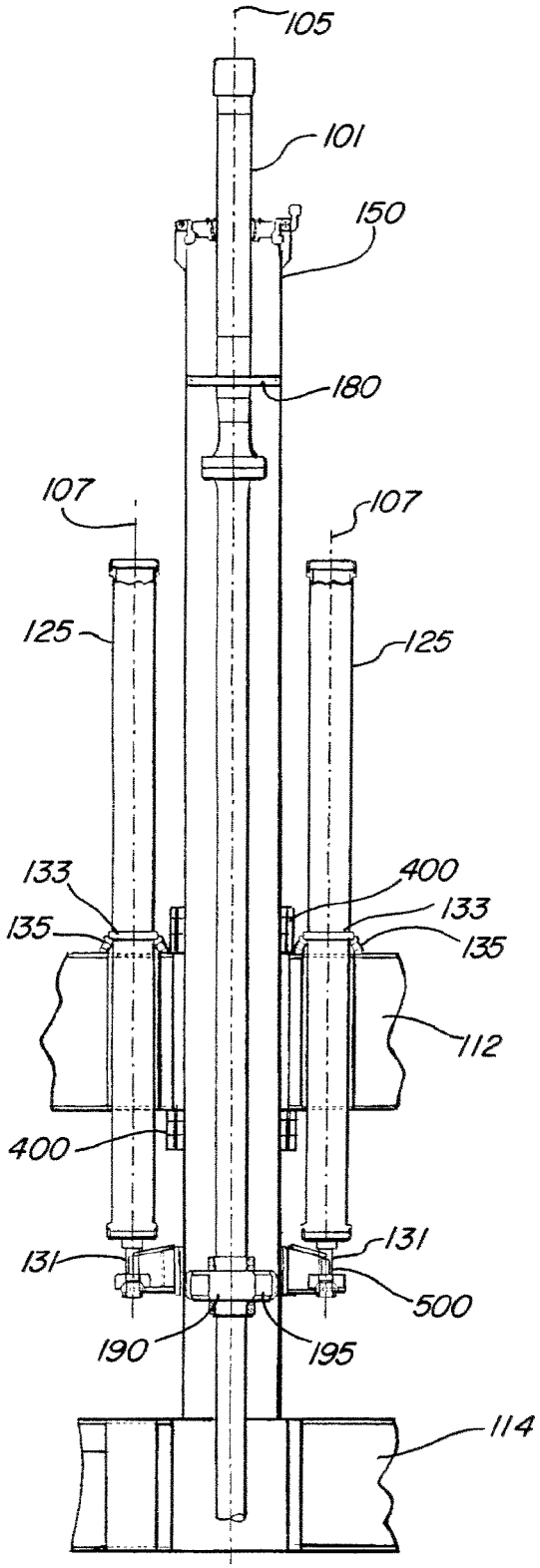
FIG. 2 is similar to FIG. 1, illustrating the hydro-pneumatic tensioner positioned at a generally maximal upstroke position.
Figure 3:
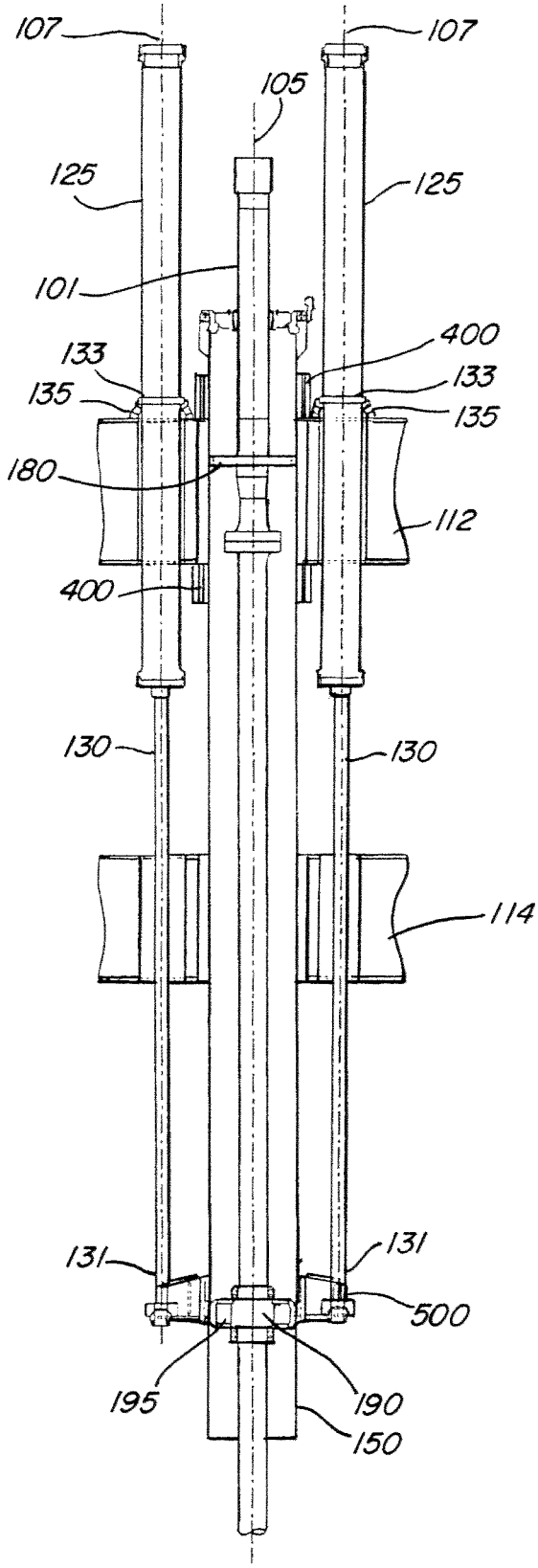
FIG. 3 is similar to FIG. 1, illustrating the hydro-pneumatic tensioner positioned at a generally maximal downstroke position.

Referring to the drawings, FIGS. 1-3 illustrate an offshore platform 100 that incorporates a tensioner system in accordance with the present invention. The platform 100 may be for example, a spar-type platform, a tension-leg platform, extended draft platform, or semi-submersible platform, or a floating vessel of the type used for drilling and production of hydrocarbons from subsea deposits (hereinafter, floating platform). The tensioner system of the present invention, as described below, may be suitable for use with an offshore dry tree floating platform, in which drilling and production equipment is disposed above the waterline. The drilling and production equipment accesses the hydrocarbon reservoir using at least one vertical pipe, or riser, which extends downward from the platform to a subsea wellhead connection (not shown). Typically, the riser comprises a string of riser sections joined end-to-end. To facilitate drilling and production operations, it is desirable to maintain the riser in tension relative to the floating platform, and a top-tensioned riser receives such tensional forces in the upper riser portion located above the waterline. A top-tensioned riser 101 is shown as a single vertical pipe solely for the purposes of illustration, and may be emblematic of a riser string comprising a plurality of riser joints, joined end-to-end, without departing from the scope of the present invention. Selected embodiments of the tensioner system may be configured for use with dry tree floating platforms having a top-tensioned riser, including, without limitation, any of the above-mentioned types of platforms. The floating platform 100 shown in the drawings, and the riser 101, exemplify a spar-type floating platform and a top-tensioned riser, respectively, which may be used in an ultradeep offshore application.

Turning to FIG. 1, the floating platform 100 may include a main deck 112 and an access deck 114. Optionally, a removable work platform 116 may be installed for worker access to perform such tasks as connecting a riser to the tensioner system to be described herein. Typically, the main deck 112 supports spar marine equipment and the topside structure, which includes drilling and production decks (not shown) to support platform drilling and production equipment (not shown), as well as pressure and reservoir fluid flow control devices (not shown). The access deck 114 is located below the main deck 112, and it may be used for equipment hook-up and long term inspection and maintenance. When present, the removable work platform 116 also may be used for equipment hook-up, inspection, and maintenance, and may be located above the main deck 112, or it may be mounted on top of and supported by the tensioning cylinders described below.

In general, the top-tensioned riser 101 is connected in a dry-tree arrangement to drilling and production equipment (not shown) disposed, for example, on or above the main deck 112. The tensioner system of the present invention, as described below, supports the top-tensioned riser 101 in alignment with a vertical axis 105, relative to the floating platform 100.

Figure 4:
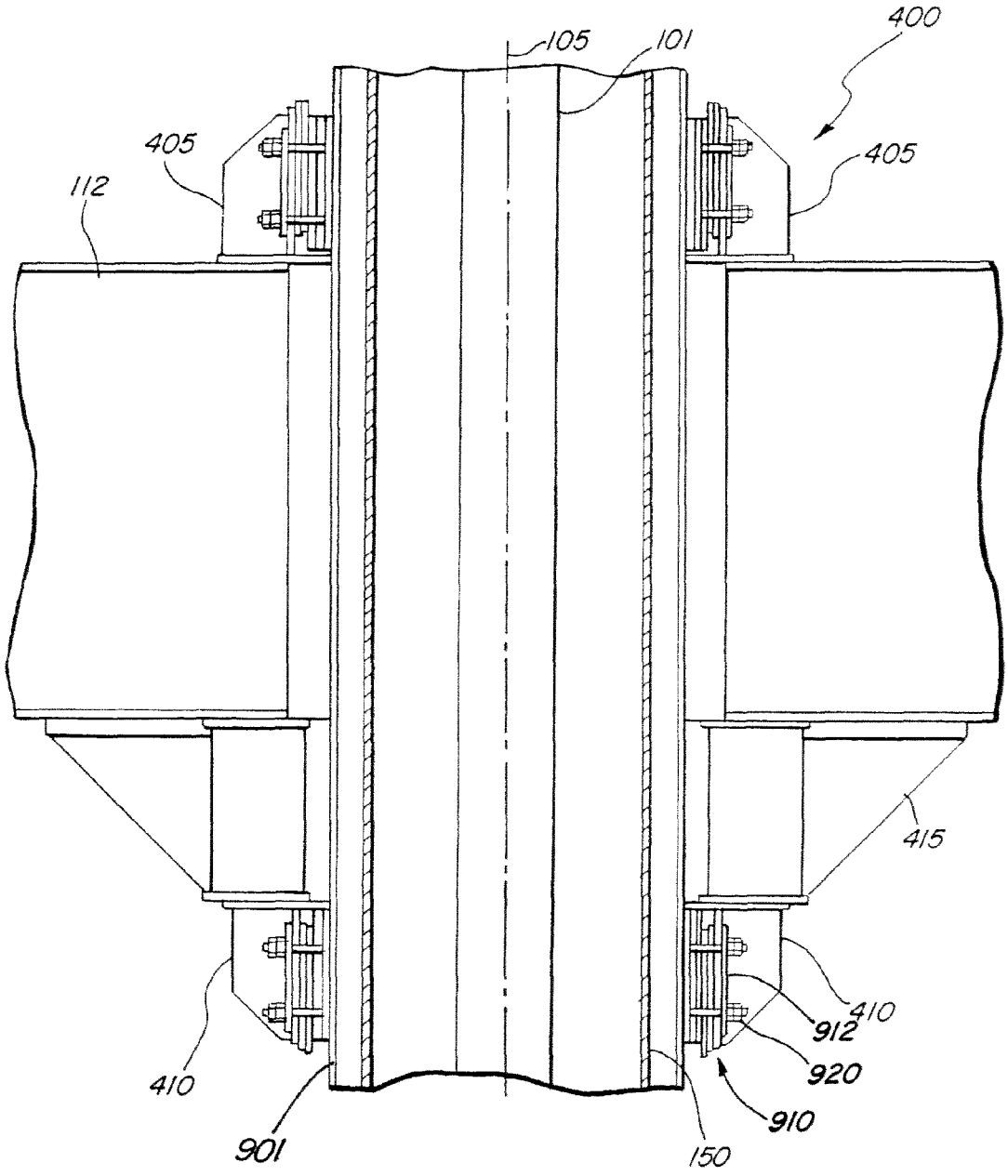
FIG. 4 illustrates a reactive load assembly, in accordance with an exemplary embodiment of the present invention, as viewed along line 4-4 of FIG. 1.
Figure 6:
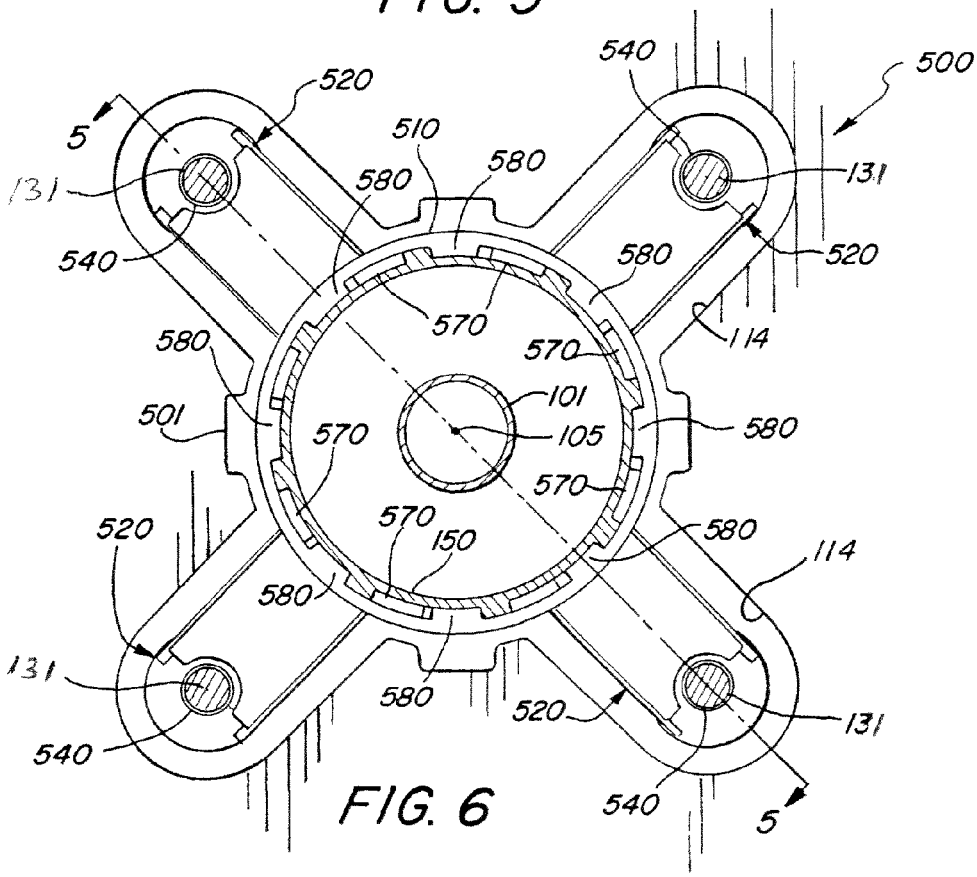
FIG. 6 is a cross-sectional view of the conductor coupling assembly shown in FIG. 5, as viewed along line 6-6 of FIG. 5.
Figure 7:
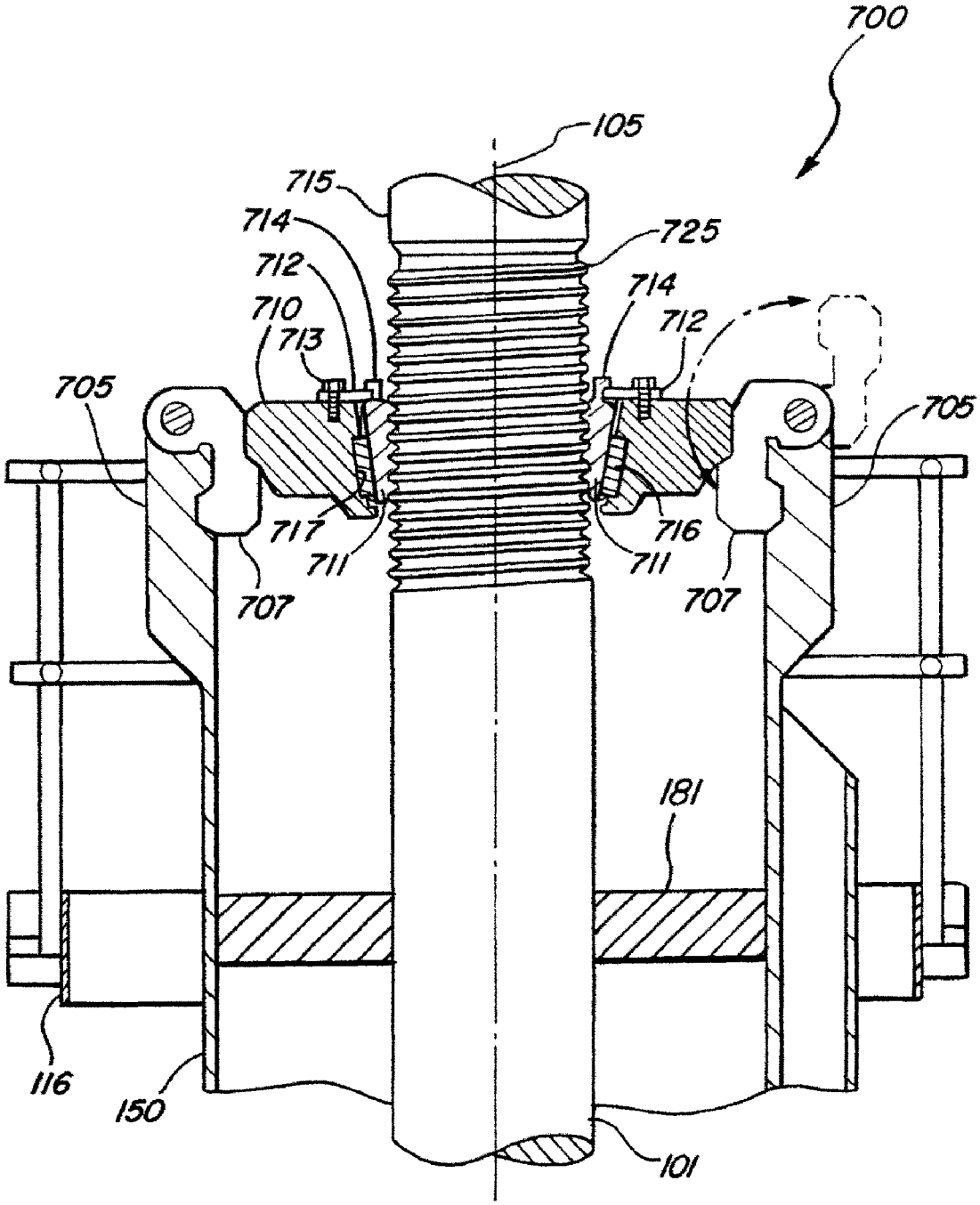
FIG. 7 is an elevational view of a riser tension joint support assembly, shown in the detail designated by the numeral 7 in FIG. 1, in accordance with an exemplary embodiment of the present invention.
Figure 8:
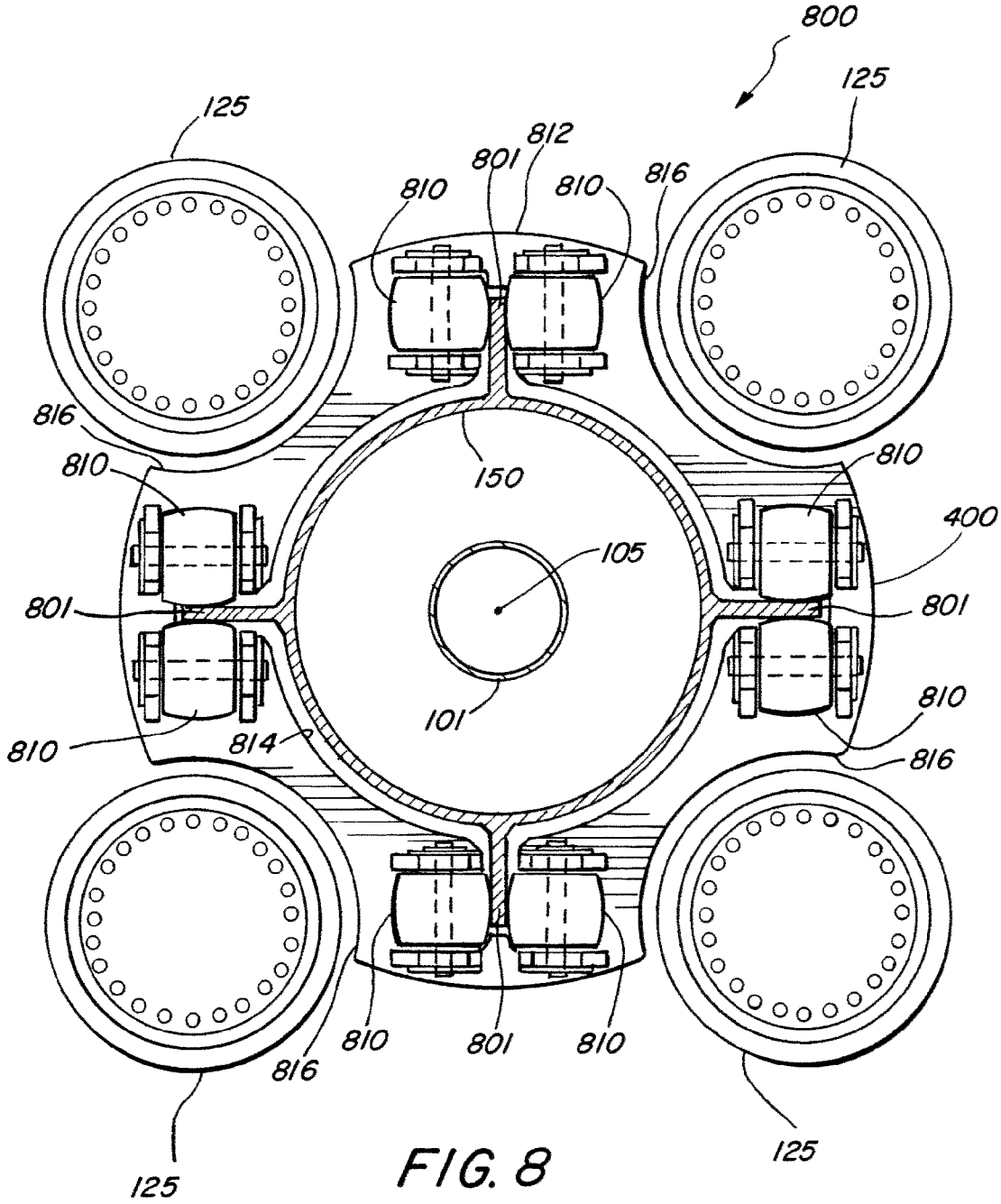
FIG. 8 is a plan view of an embodiment of a support conductor lateral reaction assembly, as may be suitable for use in the reactive load assembly of FIG. 4.
Figure 9:
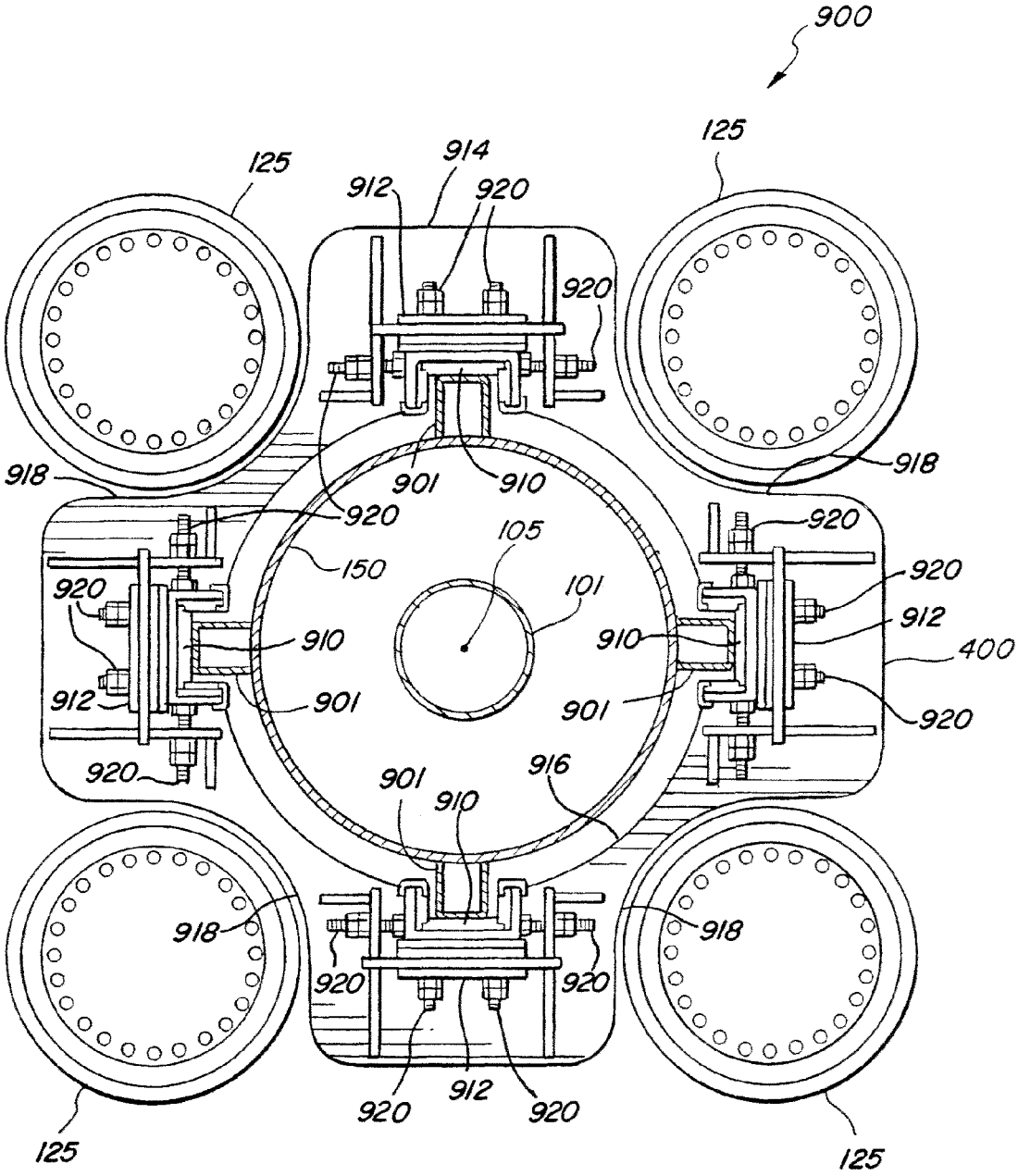
FIG. 9 is a plan view of the embodiment of a support conductor lateral reaction assembly that is shown in use in the reactive load assembly of FIG. 4.

In accordance with an exemplary embodiment of the present invention, the tensioner system for the top-tensioned riser 101 comprises a plurality of pull-style hydro-pneumatic tensioners 120 (preferably four in number), a riser support conductor 150, a reactive load assembly 400 (FIGS. 4, 8, and 9), a support conductor coupling assembly 500 (FIGS. 5 and 6), and a riser tension joint support assembly 700 (FIG. 7). In general, the riser support conductor 150 may relieve bending and torsional stresses, which otherwise may be applied directly to the riser 101, or may be communicated by the riser 101 back to the platform 100. Such stresses can adversely affect the integrity and operational life of the riser 101, especially in high sea-state conditions. The tensioners 120 and the assemblies 400, 500, and 700 cooperate with the riser support conductor 150 to exert a compensatory tensional force upon the vertical riser 101, responsive to relative platform motion induced in the floating platform 100. Relative platform motion may be caused by waves, currents, winds, and other forces common to an ultradeep marine environment, and may include complex translational and rotational motions such as heave, pitch, yaw, or a combination thereof. In FIGS. 1, 2, and 3, the reactive load assembly 400 is shown rotated with respect to the hydro-pneumatic tensioners 120 for clarity, however, FIGS. 4, 8, and 9 depict a typical orientation of the reactive load assembly 400 and its constituent elements, relative to the hydro-pneumatic tensioners 120.

The hydro-pneumatic tensioners 120 provide the riser support conductor 150 with tensional forces used to stabilize the riser 101 with respect to the platform 100 by way of the conductor coupling assembly 500 and the riser tension joint assembly 700. The conductor coupling assembly 500 communicates the tensional forces from the hydro-pneumatic tensioners 120 to the riser support conductor 150 and the riser tension joint assembly 700. The riser tension joint assembly 700, in turn, may use its rigidity (bending resistance) to resist side-to-side (lateral) bending and rotational (tortional) movement by the riser 101, and to offset static riser forces, including the weight of the riser 101. Advantageously, the reactive load assembly 400 provides a compensatory reactive force to loads imposed on the riser 101 and related structures, including, without limitation, loads producing bending moments and lateral forces.

Each of the hydro-pneumatic tensioners 120 is a pull-style hydro-pneumatic tensioner that exerts a pull-type tensional force to the upper portion of the riser 101. Depending on the requirements of a particular application, there may be four or six or more of the hydro-pneumatic tensioners 120 resiliently mounted to the floating platform in a generally symmetric arrangement. Each hydro-pneumatic tensioner 120 includes a cylinder or barrel 125 and a piston rod 130 having a first or upper end connected to a piston 136 (FIG. 10) that is slidingly journaled within the cylinder or barrel 125 for axial reciprocation therein. Each piston rod 130 has a second or lower end 131 that is coupled to the riser 101 through the support conductor 150, as described below. Each of the hydro-pneumatic tensioners 120 is a pull-type tensioner, whereby changes in riser loads and platform positions cause the rods 130 to move up and down within their respective cylinders or barrels 125, with the net effect of the movement of the rods 130 being the exertion of a pull-type tensional force to the upper portion of the riser 101. In addition, the hydro-pneumatic tensioners 120 are configured as long-stroke tensioning devices, in which the respective cylinders or barrels 125 and the rods 130 are configured to compensate for large relative displacements between the riser and the platform experienced in, for example, an ultra-deep marine environment. Therefore, the hydro-pneumatic tensioners 120 may be designated as "long-pull" hydro-pneumatic tensioners 120.

Figure 10:
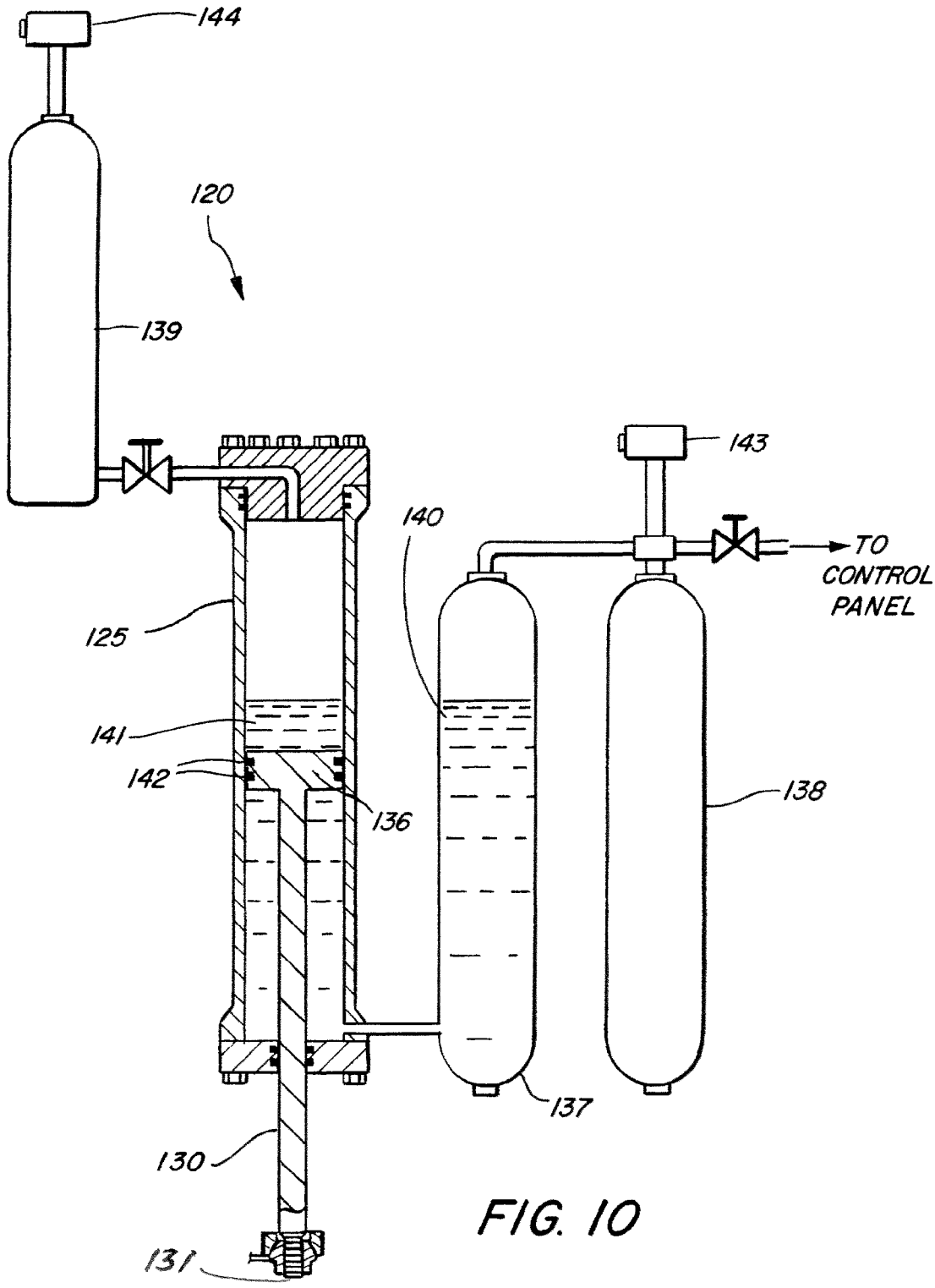
FIG. 10 is a schematic representation of the hydro-pneumatic system used to operate the hydro-pneumatic tensioners of the present invention.

Referring to FIG. 10, the cylinder or barrel 125 of each tensioner 120 is fluidly coupled, at its lower end (rod-side) to a hydraulic fluid reservoir 137 pressurized by a high-pressure pneumatic accumulator 138. The upper end (piston-side) of the cylinder or barrel 125 is fluidly coupled to a low-pressure fluid accumulator 139. A gas, such as nitrogen or dry air, at a relatively high pressure (e.g., about 1500 psi), is applied from the high-pressure pneumatic accumulator 138 to hydraulic fluid 140 in the reservoir 137, driving the hydraulic fluid to the bottom or rod side of the piston 136, thereby driving the piston 136 upwardly in the cylinder or barrel 125 to retract the rod 130 (i.e., move it upwardly in the cylinder or barrel 125), thus pulling up the support conductor 150 through the conductor coupling assembly 500, and, in turn, tensioning the riser 101. An oil- or water-based lubricant 141 may be provided to the top side of the piston 136 from the low-pressure accumulator 139 at a relatively low pressure (e.g., about 200 psi) to provide internal lubrication for piston seals 142. The application of pneumatic pressure from the high pressure pneumatic accumulator 138 and fluid pressure from the low pressure fluid accumulator 139 is controlled by conventional control mechanisms (not shown) operated from a control panel that may be provided on the main deck 112. In addition, over-pressure relief for the high pressure pneumatic accumulator 138 and the low pressure fluid accumulator may be provided by conventional "pop-off" pressure relief valves 143, 144, respectively, as is well-known in the art.

Selected embodiments of the tensioners 120 can be configured to produce total nominal operating tension loads of about 1,500 kips, with about 2,000 kips maximum. However, the tensioners 120 also may be configured to produce greater or lesser tensional loads, in accordance with the application requirements. Desirably, the hydro-pneumatic tensioners 120 are passive devices, in which the internal tensioner pressure can be monitored and adjusted through a local pneumatic control panel (not shown), of conventional design, which may communicate with a variety of sensors (not shown), such as pressure and rod stroke sensors, that generate signals that are transmitted back to the control panel. The control panel also is used in the initial riser installation to adjust the internal tensioner pressures to achieve the correct riser tension. Thereafter, it is used for monitoring only, unless there is an operational need to increase or decrease the cylinder pressures and thus the riser tension.

As shown in FIGS. 1-3, each of the hydro-pneumatic tensioners 120 is resiliently mounted to the main deck 112 by a tensioner support assembly, which may include a cylinder flange 133 and a compliant flex-bearing support member 135, respectively. The cylinder flange 133 is attached around the cylinder or barrel 125 about mid-way along its length. The flex-bearing support members 135 are mounted on the main deck 112, and are configured to resiliently engage the cylinder flange 133, respectively. Desirably, the composition of the flex-bearing support members 135 is sufficiently pliant to allow minor rotations of the cylinder or barrel 125, which tends to reduce undesirable side loads that may be conveyed to the piston rod 130 and related seals. The flex-bearing support members 135 also serve as bridge bearings for absorbing the loads of the piston rods 130 impacting the ends of the cylinders or barrels 125 in the unlikely event of a piston rod bottoming out.

FIGS. 2 and 3 illustrate an exemplary embodiment of the hydro-pneumatic tensioners 120, in which the tensioner cylinders or barrels 125 and their associated piston rods 130 are configured to provide a nominal stroke excursion of about 28 feet (8.5 m), including an upstroke of about 7 feet (2.1 m) and a downstroke of about 21 feet (6.4 m). The tensioners 120 may be configured to provide any desirable combination of upstroke and downstroke within the total stroke range of the cylinder rod 130. In FIG. 2, the hydro-pneumatic tensioners 120 are shown disposed in a generally maximal upstroke position, while in FIG. 3, the tensioners 120 are shown disposed in a generally maximal downstroke position.

The riser support conductor 150 is a vertical pipe with an inside diameter that is greater than outside diameter of the riser 101. The support conductor 150 is positioned generally coaxially around the riser 101, relative to the riser axis 105, and it extends downward from the platform 100 toward the seabed. In general, the riser 101 is run through and landed on the support conductor 150, so that the riser 101 is supported coaxially within the support conductor 150. The riser support conductor 150 communicates tensional forces from the floating platform 100 to the riser 101; restrains the riser 101 from translational and rotational motions; and reacts to bending and lateral loads placed on the riser 101 using the lateral load reaction elements 400 described below. The riser support conductor 150 is advantageously configured with a conductor tension ring interface (described below with reference to FIG. 5) configured to engage the conductor coupling assembly 500 and to receive tensional forces conveyed by the conductor coupling assembly 500 from the hydro-pneumatic tensioners 120. In an exemplary embodiment of a platform using the tensioning system of the present invention, the riser support conductor 150 can be a pipe having an inside diameter of about 50 inches (127 cm), with a wall thickness of about one inch (2.5 cm). The riser 101 also may be maintained in coaxial alignment relative to the support conductor 150, for example, using an upper riser centralizer 180 and a compliant lower riser centralizer 190. The lower centralizer 190 may advantageously include a compression bearing 195 to provide a radial contact between the riser support conductor 150 and the riser 101. The radially compliant support provided by the lower riser centralizer 190 suppresses vortex-induced vibrations ("VIV") occurring in the riser 101 in the vicinity of the conductor 150.

FIG. 4 illustrates an embodiment of the reactive load assembly 400, which may be mounted to the platform 100 to react to lateral loads and bending moments generated in the riser support conductor 150 from, for example, motions of the riser 101, a "flagpole" effect of production equipment at the upper end of the riser, or a failed tensioner 120. The reactive load assembly 400 may include two conductor lateral reaction assemblies 405, 410, to provide a force-coupled reaction to the conductor bending moment. An upper conductor lateral reaction assembly 405 may be mounted on or above the top surface of the main deck 112, while a lower conductor lateral reaction assembly 410 may be mounted on or below the lower surface the main deck 112. It may be desirable to insert a spacer structure 415 between the main deck 112 and the lower conductor lateral reaction assembly 410 to increase the distance between the conductor lateral reaction assemblies 405, 410, thereby enhancing bending moment resistance. The conductor lateral reaction assemblies 405, 410 may include lateral reaction rollers, as depicted in FIG. 8, or lateral reaction pad assemblies 910, as depicted in FIGS. 4 and 9, as will be described in detail below.

Figure 5:
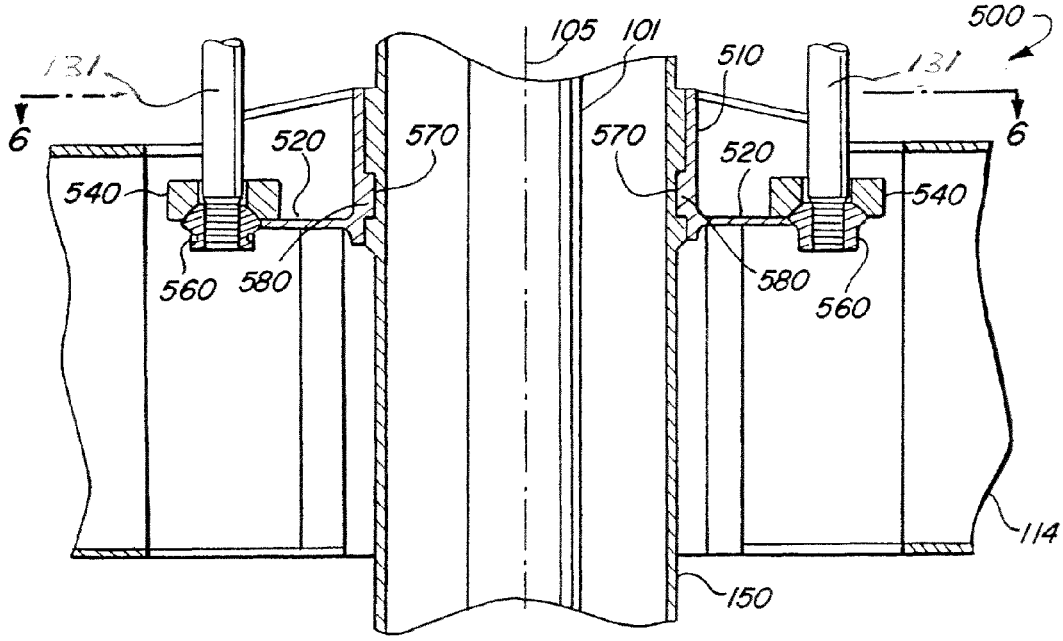
FIG. 5 is a detailed cross-sectional view of a conductor coupling assembly, in accordance with an exemplary embodiment of the present invention, as viewed along line 5-5 of FIG. 6.

FIGS. 5 and 6 illustrate an embodiment of the support conductor coupling assembly 500, by which the riser support conductor 150 is connected to the tensioners 120. In an exemplary embodiment of the invention employing four hydro-pneumatic tensioners 120, the support conductor coupling assembly 500 may be in the form of a conductor tension ring 510 from which radiate several (e.g., four) tension ring arms 520. The tension ring arms 520 may be integral with the conductor tension ring 510, or they may be plates affixed to and extending radially from the conductor tension ring 510. The tension ring arms 520 are disposed generally symmetrically around the exterior of the conductor tension ring 510, in a spatial arrangement corresponding to that of the tensioners 120. Each of the tension ring arms 520 is configured and located to connect to a respective piston rod lower end 131. Each tension ring arm 520 advantageously terminates in a load pad 540 having a bearing surface configured to receive and engage a mating tension nut 560, thereby retaining the piston rod lower ends 131 in a manner that allows some relative movement between each of the rods 130 and its corresponding tension ring arm 520.

The interior surface of the tension ring 510 is advantageously configured as a bearing surface that mates with a conductor/tension ring interface. In an exemplary embodiment, the conductor/tension ring interface comprises a plurality (e.g. eight) female J-slots 570 machined into the support conductor 150, and a like number of mating male lugs 580 projecting from the surface of the conductor tension ring body 510. The conductor J-slots 570 may be aligned with and receive the conductor mating lugs 580, after which the support conductor 150 is rotated by ⅛ turn clockwise (looking down), and is made to securely but releasably engage the conductor tension ring 510. In this way, the tension loads generated from the piston rods 130 may be transferred respectively from the lower rod ends 131 to the tension ring arms 520 extending from the tension ring 510. The tension loads then may be transferred to the support conductor 150 via the mating bearing surface formed between the conductor tension ring lugs 580 and the top of the J-slots 570 in the support conductor 150.

FIG. 7 illustrates an embodiment of the riser tension joint support assembly 700, which may include a tension joint support head 705 fixed to the top of the support conductor 150, and an adjustable tension joint donut 710 circumferentially engaging a riser tension joint 715 that is connected in-line to the upper or top end of the riser 101. The riser tension joint support assembly 700 conveys the tensional forces imposed by the hydro-pneumatic tensioners 120 on the riser support conductor 150 to the vertical riser 101. The riser tension assembly 700 also tends to maintain the riser 101 in a desired coaxial vertical alignment with the support conductor axis 105.

In general, the tension joint support head 705 engages the tension joint donut 710, which, in turn, circumferentially engages (indirectly, as discussed below) the riser tension joint 715. Specifically, a plurality of retractable load shoulder dogs 707 are pivotably attached around the upper end of the tension joint support head 705. The retractable load shoulder dogs 707 are configured to rotate radially inward and outward relative to the axis 105. When the load shoulder dogs 707 are retracted by rotating them radially outward, access is provided to the interior of the support conductor 150 to enable, for example, the installation of the riser 101 by running it through the riser support conductor 150. When landed by rotating them radially inward, the load shoulder dogs 707 provide a load shoulder for engagement by a mating shoulder on the outer periphery of the adjustable tension joint donut 710.

The inner periphery of the donut 710 is sloped radially inwardly from top to bottom so as to mate with similarly sloped or tapered outer surfaces of a pair of semi-annular engagement segments 711 that are received within the inner periphery of the donut 710. The inner surfaces of the engagement segments 711 are configured to engage and mate with a threaded or grooved section 725 in the riser tension joint 715. The tension joint donut 710 is removably fixed to the engagement segments 711 by a pair of semi-annular capture plates 712, each of which is secured to the donut 710 by an attachment member, such as a cap screw or bolt 713. The inner periphery of each of the capture plates 712 is retained in a slotted plate retainer element 714 on the upper surface of each of the engagement segments 711. By removing the cap screws or bolts 713 and thus loosening the capture plates 712, the position of the tension joint donut 710 and the engagement segments 711 may be adjusted, relative to the tension joint 715, to provide a proper riser space out, relative to the subsea wellhead (not shown), the top of the riser support conductor 150, and the tension joint support head 705. The outer surface of each of the engagement segments 711 is advantageously provided with at least one anti-rotation block 716 that is received in a mating slot 717 in the inner periphery of the donut 710, so that the donut 710 cannot rotate relative to the engagement segments 711. As shown in FIG. 7, a second upper riser centralizer 181 engaging the interior wall of the support conductor 150 and the exterior surface of the riser 101 may be disposed a short distance below the riser tension joint support assembly 700.

FIGS. 8 and 9 illustrate two alternate support conductor lateral reaction assemblies that may be suitable for use as the support conductor lateral reaction assemblies 405, 410 of the reactive load assembly 400. The support conductor lateral reaction assembly of FIG. 9 is similar to that which is partially shown in FIG. 4, while the support conductor lateral reaction assembly of FIG. 8 is an alternative embodiment that may also be used. In each of FIG. 8 and FIG. 9, the riser support conductor 150 is provided with a plurality of radially-extending conductor stabilizer elements that engage a stabilizer engagement assembly provided in the respective support conductor lateral reaction assemblies 405, 410 so as to provide generally axial guidance to the support conductor 150 and thus to the riser 101.

FIG. 8 depicts an upper support conductor lateral reaction assembly 800 that may be used as the upper support conductor lateral reaction assembly 405 mentioned above. The components of the assembly 800, described below, are mounted on a generally annular support element 812 that is fixed to the top surface of the main deck 112. It is understood that a similar assembly 800 may be employed as the lower support conductor lateral reaction assembly 410, in which case the components are mounted on a similar support element fixed to the bottom surface of the main deck 112, or to the spacer structure 415 shown in FIG. 4.

In the embodiment of FIG. 8, the radially-extending stabilizer elements are in the form of a plurality of radially-extending stabilizer plates 801, and the support conductor lateral reaction assembly 800 includes a stabilizer engagement assembly comprising a plurality of lateral reaction rollers 810 arranged in pairs, each pair engaging one of the stabilizer plates 801. The rollers 810 are mounted on the support element 812, which, as previously mentioned, is fixed to the top surface of the main deck 112. The support element 812 has a central opening 814 through which the conductor 150 passes, and an outer peripheral configuration comprising cut-outs 816 that accommodate the cylinders or barrels 125 of the tensioners 120. The engagement between the stabilizer plates 801 and the rollers 810 resists rotational forces on the conductor 150 around the axis 105. The rollers 810 may advantageously be configured for positional adjustment, both toward and away from the stabilizer plates 801, so as to compensate for fabrication tolerances and general misalignment between components to achieve the proper engagement between the rollers 810 and the stabilizer plates 801.

FIG. 9 depicts an upper support conductor lateral reaction assembly 900 that is shown as the upper support conductor lateral reaction assembly 405 in FIG. 4. Again, it is understood that a similar assembly 900 may be used as the lower support conductor lateral reaction assembly 410. The ensuing description includes components mounted on a support 914. In the case of an upper support conductor lateral reaction assembly 405, the support 914 is fixed to the top surface of the main deck 112, while in the case of a lower support conductor lateral support assembly 410, the support is fixed to the bottom surface of the man deck 112, or to the spacer structure 415 shown in FIG. 4.

In the FIG. 9 embodiment, the radially-extending stabilizer elements are tubular stabilizer members 901, and the support conductor lateral reaction assembly 900 includes a stabilizer engagement assembly comprising a plurality of resilient lateral reaction pad assemblies 910, each pad assembly 910 engaging one of the stabilizer members 901. Each pair of the pad assemblies 910 is mounted in a position-adjustable fixture 912, and the fixtures 912, in turn, are mounted on a support 914 fixed to the deck 112, as mentioned above. The support 914 has a central aperture 916 through which the conductor 150 passes. The outer periphery of the support 914 is configured with a plurality of cut-outs 918 that accommodate the cylinders or barrels 125 of the tensioners 120. Each of the reaction pad assemblies 910 comprises an arrangement of bearing pads (either metallic or non-metallic), and the engagement between the stabilizer members 901 and the corresponding pad assemblies 910 serves to resist rotational forces on the conductor 150. The fixtures 912 are advantageously configured for positional adjustment by suitable means, such as an arrangement of adjustment screws 920 to compensate for fabrication tolerances and general misalignment between components.

From the foregoing description, it will be appreciated that the riser axial load path from the upper portion of the riser 101 to the spar tensioner support deck (i.e., the main deck 112) is through the riser tension joint support assembly 700, then to the upper end of the support conductor 150. From there, the axial load is transmitted through the support conductor wall down to the attachment points between the piston rod lower ends 131 and the tension ring arms 520. The riser tension is provided by the tensioner piston rods 130 that are actually riding on the hydraulic pressure provided by the tensioner cylinder or barrel 125 charged with nitrogen or dry air from the interconnected high pressure pneumatic accumulator 138. The same pressure is pulling the cylinder or barrel 125 down against the platform support structure (such as the main deck 112), thus completing the load path from the upper portion of the riser to the platform support structure. By contrast, prior art tensioners only subject the support conductor to a pair of lateral loads and the bending moment imposed at the top of the support conductor through the flag pole effect of the surface equipment. The present invention, on the other hand, uses the large cross sectional area of the support conductor 150 to support the riser axial load in a compressive load fashion, in addition to providing the lateral support to the upper portion of the riser near its top or upper end.

As will be appreciated from the detailed description above, the present invention offers significant advantages, including, without limitation: (1) the stroke and tensioning capacity can be adjustable to suit a wide range of riser systems; (2) the cylinders or barrels of the hydro-pneumatic tensioners are installed and operate vertically, which enables a failed tensioner to be removed easily from service for repair, requiring limited below-deck activity; (3) the support conductor can be installed vertically and can be connected to the conductor tension ring by a simple ⅛ turn breech-lock connection; (4) a piston rod can be attached to the conductor tension ring using a simple spherical bearing tension nut: (5) the use of the support conductor allows the riser to be centralized prior to engaging the tension ring during installation, which also advantageously extends riser fatigue life during operation; (6) the support conductor and the lateral load reaction elements resist riser rotation and riser conductor bending moments induced from riser loads, the "flagpole" effect of equipment above the tension ring, or a failed tensioner; (7) the compliant lower riser centralizer provides a mechanism for VIV suppression; (8) the compliant flex-bearing support members 135 absorb the impact load in the event a piston rod bottoms out during, for example an extreme environmental event; and (9) the tension joint support assembly 700 (specifically the tension joint donut 710 and the shoulder dogs 707) allows for piston rod top-out without damaging the riser support conductor, with a consequent possible release of the riser.

The above described example embodiments of the present invention are intended as teaching examples only. These example embodiments are in no way intended to be exhaustive of the scope of the present invention, as defined in the claims that follow.

What is claimed is:

1. A tensioner system for a riser in a floating platform having a deck, comprising:

a riser support conductor surrounding the riser and having an upper end coupled to an upper portion of the riser;

a hydro-pneumatic tensioner assembly coupled between the deck and a lower end of the riser support conductor so as to exert a pull-type tensional force on the riser support conductor, whereby the riser support conductor conveys the pull-type tensional force to the upper portion of the riser; and a reactive load assembly mounted to the floating platform and configured to receive the riser support conductor so as to react to a two-point dynamic bending moment imposed on the riser support conductor.

2. The tensioner system of claim 1, wherein the riser support conductor includes a plurality of radially-extending stabilizer elements operatively engaged by the reactive load assembly so as to resist rotational forces.

3. The tensioner system of claim 2, wherein the reactive load assembly comprises:

a support element secured to the platform and having a central opening through which the riser support conductor passes; and a stabilizer engagement assembly mounted on the support element and configured to engage the stabilizer elements.

4. The tensioner system of claim 3, wherein the stabilizer engagement assembly is positionally adjustable relative to stabilizer elements.

5. The tensioner system of claim 4, wherein the stabilizer engagement assembly comprises a plurality of roller pairs, wherein the rollers in each pair are configured and located so as to engage the stabilizer elements.

6. The tensioner system of claim 4, wherein the stabilizer engagement assembly comprises a plurality of bearing pad arrangements, each configured and located so as to engage the stabilizer elements.

7. The tensioner system of claim 1, further comprising a support conductor coupling assembly operatively connecting the hydro-pneumatic tensioner assembly to the support conductor so as to transfer a tension load from the hydro-pneumatic tensioner assembly to the riser support conductor.

8. The tensioner system of claim 1, wherein the hydro-pneumatic tensioner assembly comprises a plurality of hydro-pneumatic tensioners, each of which comprises:

a cylinder coupled to a source of pneumatically-pressurized hydraulic fluid;

a hydraulically-actuated piston disposed for axial reciprocation within the cylinder; and a piston rod having a first end connected to the piston and a second end operatively coupled to the riser support conductor.

9. A hydro-pneumatic tensioner system for a top-tensioned riser in a floating platform, comprising:

a riser support conductor coaxially surrounding the riser and having an upper end and a lower end;

a riser tension joint support assembly operatively coupling the upper end of the riser support conductor to an upper end of the riser so as to convey an axial tension load thereto from the riser support conductor;

a hydro-pneumatic tensioner assembly mounted to the floating platform; and a support conductor coupling assembly operatively coupling the tensioner assembly to the lower end of the riser support conductor so as to convey an axial tension load from the tensioner assembly to the riser support conductor;

wherein the tensioner assembly, the support conductor coupling assembly, and the riser tension joint assembly cooperate with the riser support conductor to exert a pull-type tensional force upon the top-tensioned riser, responsive to motion induced in the floating platform.

10. The tensioner system of claim 9, wherein the hydro-pneumatic tensioner assembly comprises a plurality of pull-type hydro-pneumatic tensioners configured to provide a long-stroke, pull-type tensional force applied to the riser support conductor.

11. The tensioner system of claim 9, further comprising:

a reactive load assembly mounted to the floating platform and configured to receive the riser support conductor, wherein the reactive load assembly reacts with a two-point dynamic bending moment imposed on at least one of the top-tensioned riser and the riser support conductor.

12. The tensioner system of claim 11, wherein the reactive load assembly comprises at least two lateral reaction assemblies, and wherein the riser support conductor includes a plurality of radially-extending stabilizer elements operatively engaged by the lateral reaction assemblies so as to resist rotational forces on the support conductor.

13. The tensioner system of claim 12, wherein each of the lateral reaction assemblies comprises:

a support element secured to the platform and having a central opening through which the riser support conductor passes; and a stabilizer engagement assembly mounted on the support element and configured to engage the stabilizer elements.

14. The tensioner system of claim 13, wherein the stabilizer engagement assembly is positionally adjustable relative to the stabilizer elements.

15. The tensioner system of claim 14, wherein the stabilizer engagement assembly comprises a plurality of roller pairs, wherein the rollers in each pair are configured and located so as to engage the stabilizer elements.

16. The tensioner system of claim 14, wherein the stabilizer engagement assembly comprises a plurality of bearing pad arrangements, each configured and located so as to engage the stabilizer elements.

17. The tensioner system of claim 9, wherein the tensioner assembly comprises a plurality of hydro-pneumatic tensioners, each of which comprises:

a cylinder coupled to a source of pneumatically-pressurized hydraulic fluid;

a hydraulically-actuated piston disposed for axial reciprocation within the cylinder; and a piston rod having a first end connected to the piston and a second end operatively connected to the support conductor coupling assembly.

18. The tensioner system of claim 17, wherein the support conductor coupling assembly comprises:

a conductor tension ring having an interior surface operatively engaging the riser support conductor; and a plurality of tension ring arms extending radially from the conductor tension ring, each of the tension ring arms being operatively connected to the second end of one of the piston rods.

19. The tensioner system of claim 9, wherein the riser has an upper end connected to a riser tension joint, and wherein the tensioner system further comprises a riser tension joint support assembly that comprises:

a plurality of load shoulder elements connected to the upper end of the riser support conductor; and a tension joint donut circumferentially engaging the riser tension joint and having an outer periphery engaging the load shoulder elements so as to convey a tensional force from the riser support conductor to the riser through the load shoulder elements and the donut.

20. The tensioner system of claim 19, wherein the load shoulder elements are pivotably connected to the upper end of the riser support conductor so as to be pivotable between a retracted position allowing access to the interior of the riser support conductor, and a landed position engaging the donut.

21. A tensioner system for a top-tensioned riser in a floating platform, comprising:

a riser support conductor coaxially surrounding and operatively coupled to the riser, the riser support conductor having a plurality of radially-extending stabilizer elements;

a pull-type tensioning assembly operatively coupled between the floating platform and the riser support conductor; and a reactive load assembly mounted to the floating platform and configured to receive the riser support conductor, the reactive load assembly comprising at least two lateral reaction assembles operatively engaging the stabilizer elements so as to resist rotational forces on the riser support conductor;

wherein the reactive load assembly reacts with a two-point dynamic bending moment imposed on at least one of the top-tensioned riser and the riser support conductor; and wherein each of the lateral reaction assemblies comprises:

a support element secured to the floating platform and having a central opening through which the riser support conductor passes; and a stabilizer engagement assembly mounted on the support element and configured to engage the stabilizer elements.

22. The platform of claim 21, wherein the stabilizer engagement assembly is positionally adjustable relative to the stabilizer elements.

23. The platform of claim 22, wherein the stabilizer engagement assembly comprises a plurality of roller pairs, wherein the rollers in each pair are configured and located so as to engage the stabilizer elements.

24. The platform of claim 22, wherein the stabilizer engagement assembly comprises a plurality of bearing pad arrangements, each configured and located so as to engage the stabilizer elements.

25. A tensioner system for a riser in a floating platform having a deck, comprising:

a riser support conductor surrounding the riser and having an upper end coupled to an upper portion of the riser; and a hydro-pneumatic tensioner assembly coupled between the deck and a lower end of the riser support conductor so as to exert a pull-type tensional force on the riser support conductor, whereby the riser support conductor conveys the pull-type tensional force to the upper portion of the riser;

wherein the riser has an upper end connected to a riser tension joint, wherein the riser support conductor has an upper end, and wherein the tensioner system further comprises a riser tension joint support assembly that comprises:

a plurality of load shoulder elements connected to the upper end of the riser support conductor; and a tension joint donut circumferentially engaging the riser tension joint and having an outer periphery engaging the load shoulder elements so as to convey a tensional force from the riser support conductor to the riser through the load shoulder elements and the donut.

26. The tensioner system of claim 25, wherein the load shoulder elements are pivotably connected to the upper end of the riser support conductor so as to be pivotable between a retracted position allowing access to the interior of the riser support conductor, and a landed position engaging the donut.

* * * * *

UNITED STATES PATENT AND TRADEMARK OFFICE

CERTIFICATE OF CORRECTION

PATENT NO. : 8,021,081 B2
APPLICATION NO. : 11/761061
DATED : September 20, 2011
INVENTOR(S) : Gerald Crotwell et al.

It is certified that error appears in the above-identified patent and that said Letters Patent is hereby corrected as shown below:

On the Face Page, in field (57), in Abstract, in column 2, line 13, delete "Also" and insert -- Also, --, therefor.

In column 1, line 25, delete "applications" and insert -- applications, --, therefor.

In column 4, line 23, delete "invention" and insert -- invention, --, therefor.

In column 4, line 26, delete "position:" and insert -- position; --, therefor.

In column 4, line 65, delete "be" and insert -- be, --, therefor.

In column 6, line 5, delete "clarity," and insert -- clarity; --, therefor.

In column 6, line 18, delete "(tortional)" and insert -- (torsional) --, therefor.

In column 11, line 54, delete "nut:" and insert -- nut; --, therefor.

Signed and Sealed this
Eighth Day of November, 2011

David J. Kappos
*Director of the United States Patent and Trademark Office*